US007891509B2

(12) United States Patent
Konefal

(10) Patent No.: US 7,891,509 B2
(45) Date of Patent: Feb. 22, 2011

(54) CLOSURE AND CONTAINER PACKAGE HAVING CHILD-RESISTANT AND NON-CHILD-RESISTANT MODES OF OPERATION

(75) Inventor: Robert S. Konefal, Wilton, NH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 847 days.

(21) Appl. No.: 11/602,023

(22) Filed: Nov. 20, 2006

(65) Prior Publication Data

US 2007/0062901 A1 Mar. 22, 2007

Related U.S. Application Data

(63) Continuation of application No. 10/386,192, filed on Mar. 10, 2003, now abandoned.

(51) Int. Cl.
*B65D 50/08* (2006.01)
*B65D 55/02* (2006.01)

(52) U.S. Cl. ..... 215/216; 215/219; 215/228; 215/330

(58) Field of Classification Search ..... 215/219, 215/228, 329, 216, 330, 221, 224, 225
See application file for complete search history.

(56) References Cited

U.S. PATENT DOCUMENTS 3,865,267 A * 2/1975 Morris ..... 215/206
4,103,797 A * 8/1978 Morris ..... 215/209
2004/0173561 A1* 9/2004 Wolfe ..... 215/209

* cited by examiner

*Primary Examiner*—Anthony Stashick
*Assistant Examiner*—James N Smalley
(74) *Attorney, Agent, or Firm*—Reising Ethington PC

(57) ABSTRACT

A package having child-resistant and non-child-resistant modes of operation includes a plastic container having a cylindrical finish and at least one external thread on the finish spaced from the open end of the finish. An external circumferentially extending first engagement element is provided on the finish between the external thread and the open end of the finish, and has an outside diameter that is less than that of the external thread. A manually deflectable release element is externally cantilevered from the finish on a side of the thread remote from the open end. A plastic closure has a base wall and a peripheral skirt with at least one internal thread for engagement with the at least one external thread on the finish in a child-resistant mode of operation. There is at least one locking lug on the skirt for releasable engagement with the release element on the container in the child-resistant mode of operation. An annular wall extends from the base wall in a direction opposite from the skirt. A second engagement element is disposed on the inner surface of the annular wall for engagement with the first engagement element on the container finish in an inverted non-child-resistant mode of operation of the closure. In disclosed embodiments of the invention, the engagement elements may comprise circumferential beads or circumferential threads on the container finish and the annular wall of the closure.

2 Claims, 6 Drawing Sheets

CLOSURE AND CONTAINER PACKAGE HAVING CHILD-RESISTANT AND NON-CHILD-RESISTANT MODES OF OPERATION

This application is a continuation of application Ser. No. 10/386,192 filed Mar. 10, 2003 now abandoned.

The present invention relates to child-resistant closure and container packages, such as medicinal packages for example, to closures and containers for such packages, and to methods of making such packages.

Reference is made to U.S. application Ser. Nos. 10/768,374, 10/388,293, 10/378,441, 10/684,724 and 10/378,434 assigned to the assignee of the present application.

BACKGROUND AND SUMMARY OF THE INVENTION

U.S. Pat. Nos. 5,899,348, 6,039,195 and 6,327,770 disclose closure and container packages that are particularly well suited for prescription applications. The container includes a sidewall with an externally threaded finish and a deflectable release element cantilevered from the finish on a side of the threads remote from the open mouth of the container. The closure includes a base wall with an internally threaded peripheral skirt having locking lugs at the edge of the skirt remote from the base wall. These locking lugs on the skirt cooperate with a locking lug on the deflectable release element of the container to secure the closure to the container in a child-resistant mode of operation. To release the closure, the release element is deflected downwardly toward the container sidewall to move the locking lug on the release element out of engagement with the locking lugs on the closure skirt. A dome extends from the inner periphery of the base wall and has an external thread that is adapted to be received within the open mouth of the container in an inverted non-child-resistant mode of operation of the closure. Although the packages disclosed in the noted patents have enjoyed substantial commercial acceptance and success, improvements remain desirable. In particular, it is desirable to provide a package of this general type in which material and part costs are reduced, and in which the overall height of the package presents a lower profile for handling and storage.

The present invention embodies a number of aspects that can be implemented separately from or, more preferably, in combination with each other.

A package having child-resistant and non-child-resistant modes of operation in accordance with one aspect of the present invention includes a plastic container having a cylindrical finish and at least one external thread on the finish spaced from the open end of the finish. An external circumferentially extending first engagement element is provided on the finish between the external thread and the open end of the finish, and has an outside diameter that is less than that of the external thread. A manually deflectable release element is externally cantilevered from the finish on a side of the thread remote from the open end. A plastic closure has a base wall and a peripheral skirt with at least one internal thread for engagement with the at least one external thread on the finish in a child-resistant mode of operation. There is at least one locking lug on the skirt for releasable engagement with the release element on the container in the child-resistant mode of operation. An annular wall extends from the base wall in a direction opposite from the skirt. A second engagement element is disposed on the inner surface of the annular wall for engagement with the first engagement element on the container finish in an inverted non-child-resistant mode of operation of the closure. In disclosed embodiments of the invention, the engagement elements may comprise circumferential beads or circumferential threads on the container finish and the annular wall of the closure.

BRIEF DESCRIPTION OF THE DRAWINGS

The invention, together with additional objects, features, advantages and aspects thereof, will be best understood from the following description, the appended claims and the accompanying drawings in which:

DETAILED DESCRIPTION OF PREFERRED EMBODIMENTS

FIGS. 1-4 illustrate a closure and container package 20 in accordance with one exemplary but presently preferred embodiment of the invention as including a container 22 and a closure 24. Container 22 preferably is of one-piece molded construction of suitable plastic such as polypropylene. Likewise, closure 24 preferably is of one-piece molded plastic construction of suitable resin material such as polypropylene. However, description of closure and container package 20 as comprising a one-piece container and a one-piece closure does not preclude inclusion of other elements in the package, such as a sealing liner secured over the container mouth that must be removed to dispense product from the container, devices to hold down pelletized products such as vitamin tablets within the container, etc. The package can be employed for dispensing prescriptions, medicinal products such as vitamins or aspirin, etc.

Figure 7:
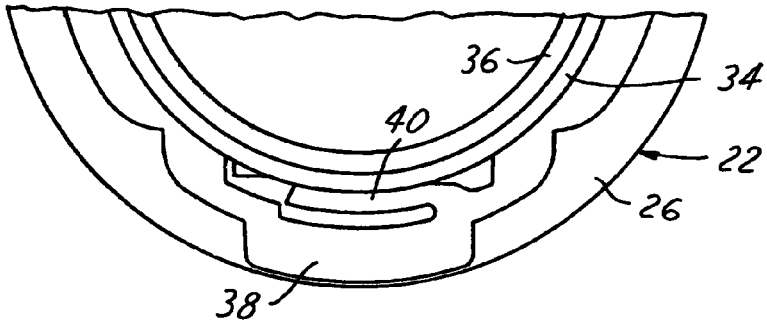
FIG. 7 is a fragmentary top plan view of the container in FIG. 6.
Figure 6:
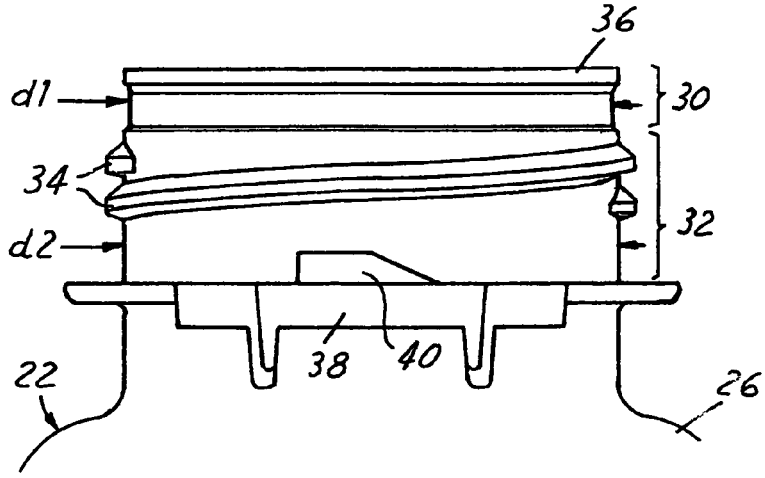
FIG. 6 is a fragmentary elevational view of the container in the package of FIGS. 1-4.
Figure 8:
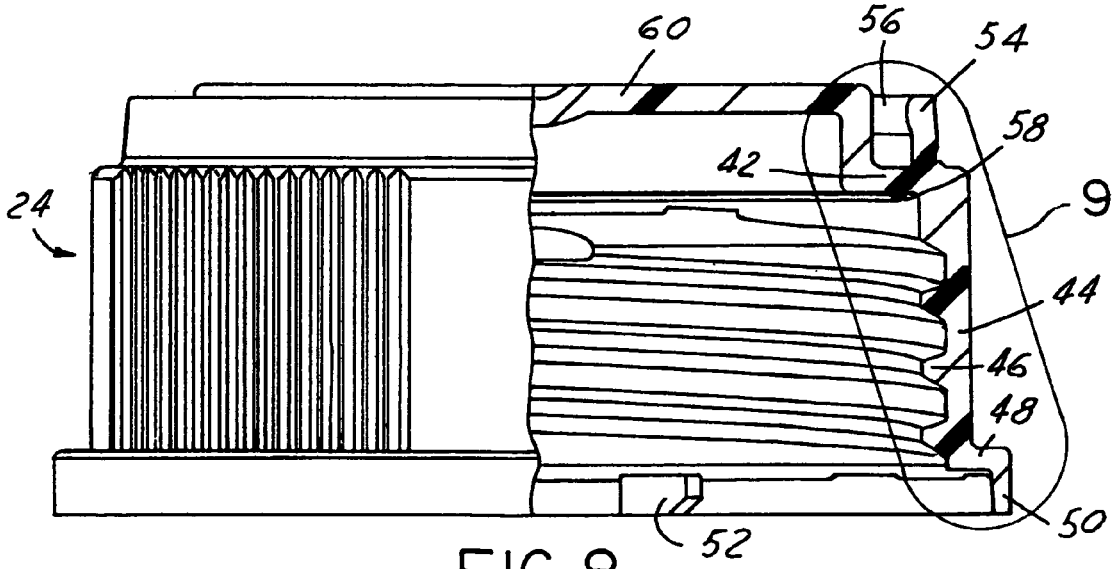
FIG. 8 is a partially sectioned elevational view of the closure in the package of FIGS. 1-4.
Figure 9:
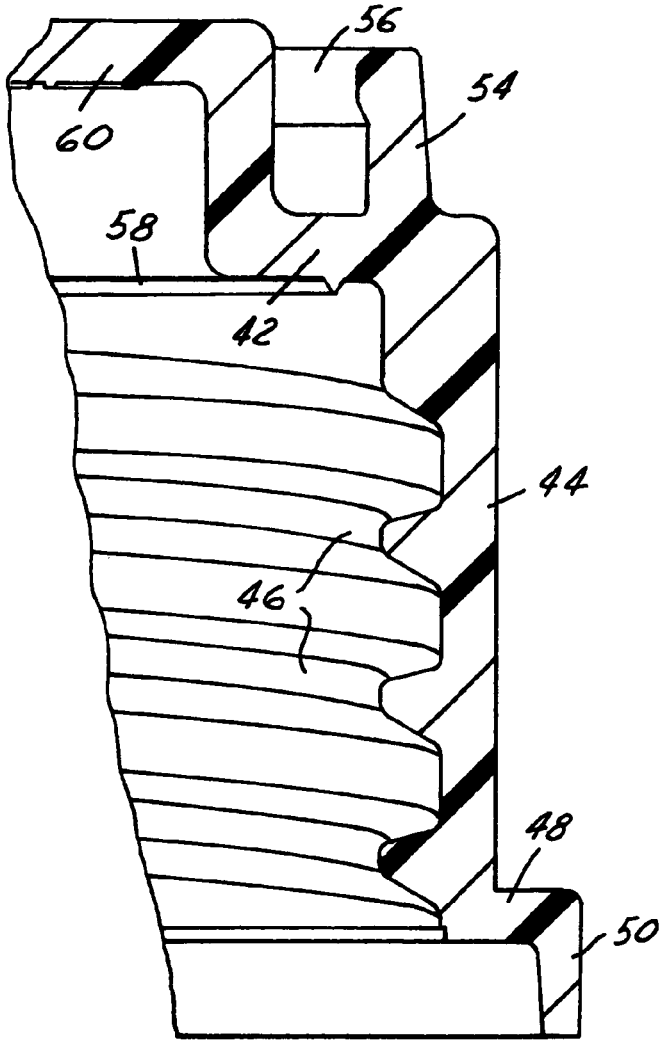
FIG. 9 is a fragmentary sectional views on an enlarged scale of the portion of FIG. 8 within the area 9.

Container 22 includes a body 26 from which a finish 28 integrally extends. Finish 28 includes a first portion 30 (FIGS. 2 and 6) adjacent to and surrounding the mouth at the open end of the finish, and a second portion 32 contiguous with portion 30 and spaced from the open end of the container. The outside diameter d1 (FIG. 6) of container portion 30 is less than the outside diameter d2 of container portion 32. At least one external thread 34 is disposed around container finish portion 32. An external bead 36 is disposed around container portion 30 at or adjacent to the open end of the container finish, and is thus disposed between external threads 34 and the open end of the container finish. External bead 36 preferably has an outside diameter equal to the outside diameter d2 of finish portion 32. Bead 36 may be disposed at the open end of the container as illustrated in the drawings, or spaced axially from the open end of the container. (Directional words such as "upper" and "lower" are employed by way of description and not limitation with respect to the upright orientation of the container and package illustrated in the drawings. Directional words such as "radial" and "axial" are employed by way of description and not limitation with respect to the central axis of the container finish or the closure as appropriate.) A release element 38 is flexibly and resiliently cantilevered radially outwardly from the lower end of container finish 28. A locking lug 40 (FIGS. 6 and 7) is carried by release element 38. Release element 38 and locking lug 40 preferably are as disclosed in above-noted U.S. Pat. Nos. 5,899,348, 6,039,195 and 6,327,770. The release element and locking lug alternatively but less preferably may be as disclosed in U.S. Pat. No. 5,711,442. The disclosures of these patents are incorporated herein by reference.

Figure 4:
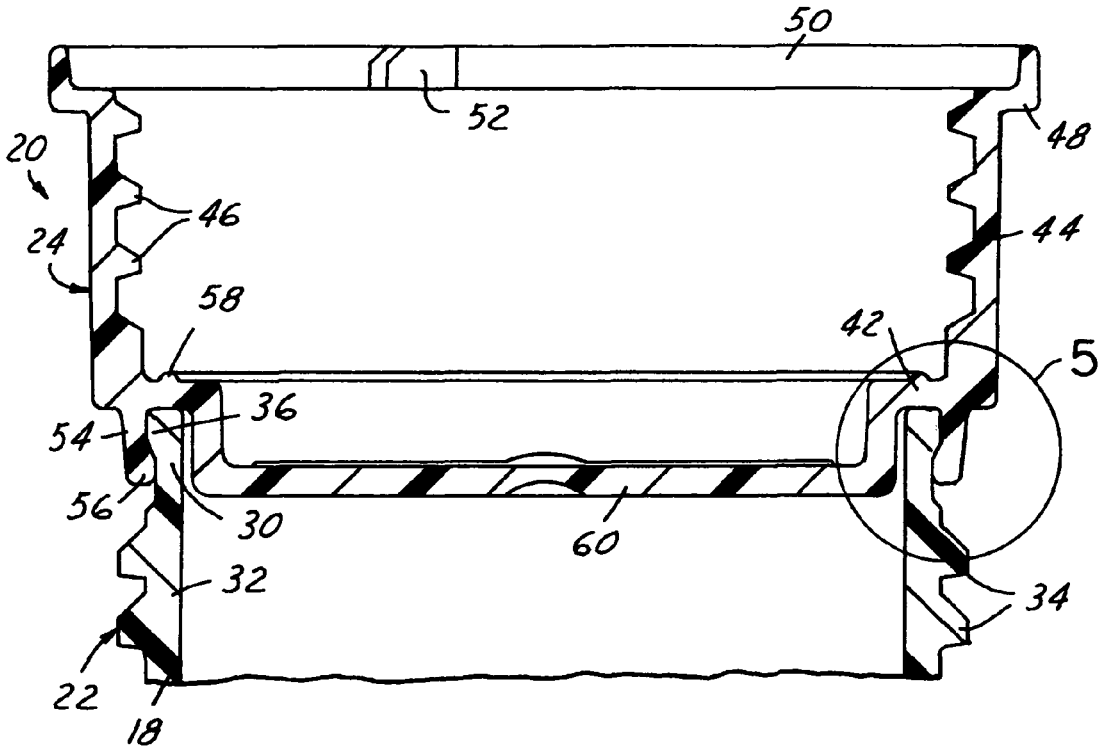
FIG. 4 is a fragmentary sectional view of the package in FIG. 1 in a non-child-resistant resistant mode of operation.
Figure 5:
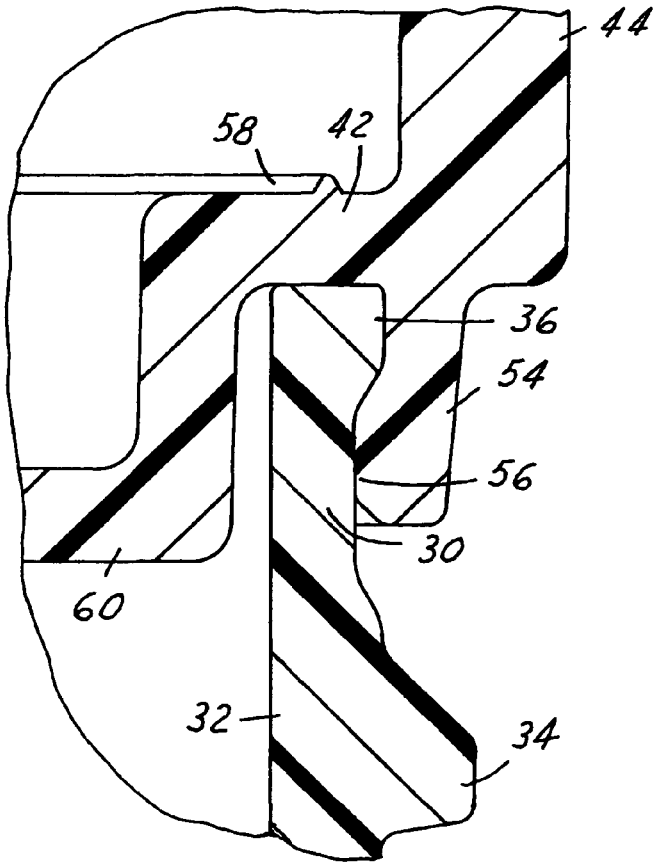
FIG. 5 is a fragmentary sectional view on an enlarged scale of the portion of FIG. 4 within the area 5.

Closure 24 includes a base wall 42 and a peripheral skirt 44 with one or more internal threads 46. A flange 48 extends radially outwardly from the lower edge of skirt 44 remote from base wall 42 in the preferred embodiments of the invention, and an outer skirt 50 extends from the outer peripheral edge of flange 48. Skirts 44, 50 preferably are cylindrical and concentric with the axis of the closure. At least one locking lug 52 is disposed on the internal surface of skirt 50. An annular wall 54 extends axially from base wall 42 in a direction opposite from skirt 44. In the preferred embodiments of the invention, annular wall 54 is disposed radially inwardly from skirt 44 and is coaxial with skirt 44. A circumferential bead 56 extends radially inwardly from the inner surface of annular wall 54 at a position spaced from base wall 42. A seal rib 58 is disposed on the undersurface of base wall 42 radially inwardly of and concentrically with skirt 44. In the preferred embodiments of the closure illustrated in the drawings, base wall 42 is of flat planar annular construction, having concentric inner and outer peripheral edges. Internally threaded skirt 44 extends from the outer peripheral edge of base wall 42. A projection or plug 60 preferably extends from the inner peripheral edge of base wall 42 in a direction opposite from skirt 44, and is disposed radially inwardly from annular wall 54. Projection 60 has a flat upper wall on which printing may be molded or otherwise provided to advise a user how to open the package in the child-resistant mode of operation, or that the package is non-child-resistant in the non-child-resistant mode of operation (FIG. 2) of the closure (FIG. 4). Projection 60 preferably is cylindrical, and may be solid or, more preferably, hollow as shown in the drawing.

Figure 1:
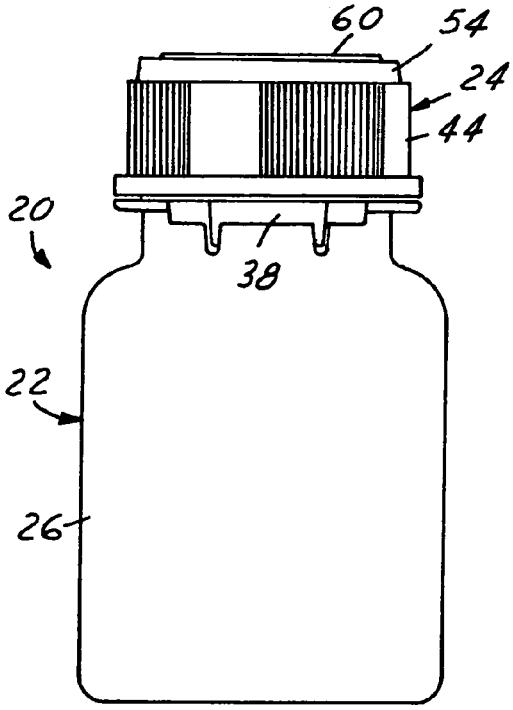
FIG. 1 is an elevational view of a closure and container package in a child-resistant mode of operation in accordance with one exemplary but presently preferred embodiment of the invention.
Figure 3:
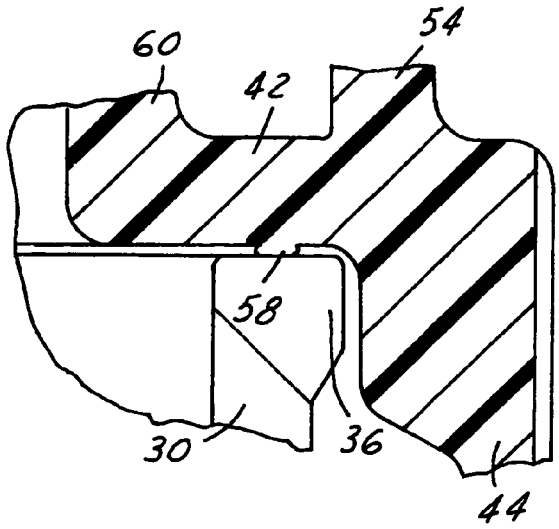
FIG. 3 is a fragmentary sectional view on an enlarged scale of the portion of FIG. 2 within the area 3.
Figure 2:
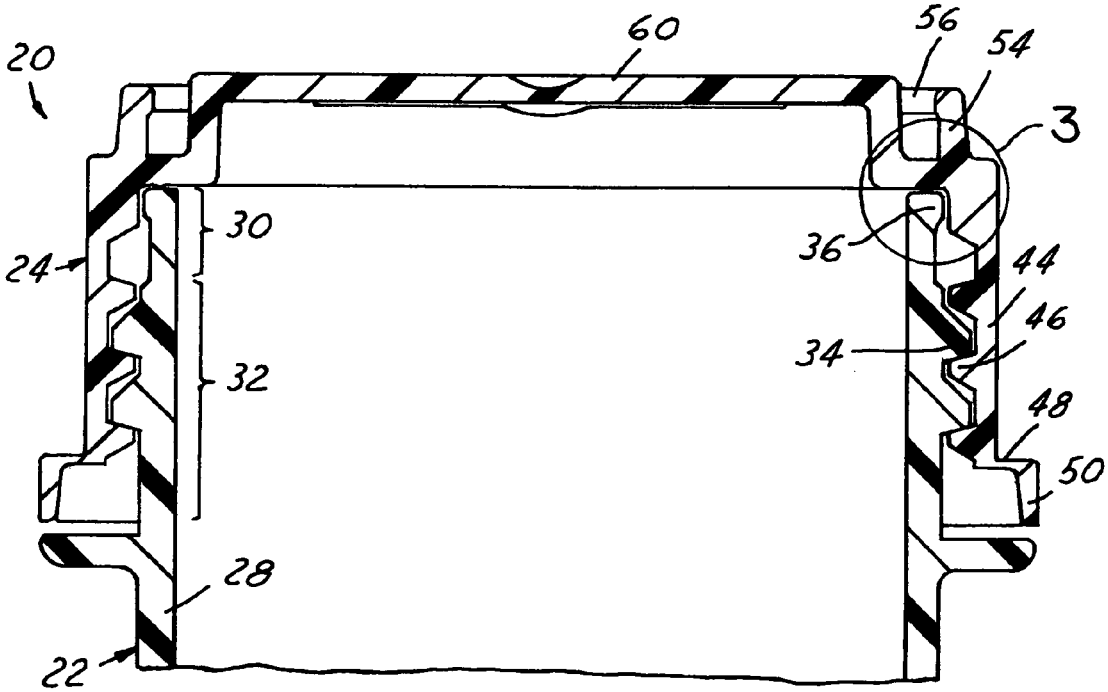
FIG. 2 is a fragmentary sectional view of the package illustrated in FIG. 1.

In the child-resistant mode of operation illustrated in FIGS. 1-3, closure skirt 44 is threaded over external threads 34 on container finish portion 32 until one of the internal locking lugs 52 on closure 24 rides over locking lug 40 on release element 38. Abutment of the locking lugs prevents counterclockwise rotation of the closure with respect to the finish, and thus prevents removal of the closure from the container in the child-resistant mode of operation. Seal bead 58 on the underside of base wall 42 is in engagement with and compressed by the axial end of container finish 28, as best seen in FIGS. 2 and 3, to seal the package. To remove the closure in the child-resistant mode of operation, release element 38 is pushed downwardly away from the closure skirt. Locking lug 40 on release element 38 is thus moved downwardly with the release element out of locking engagement with lug 52 on closure 24, so that the closure can now be rotated counterclockwise and unthreaded from the container finish. The reduced diameter of container finish portion 30 and bead 36 with respect to container finish portion 32 and external threads 34 permit closure skirt 44 readily to be received over the open end of the container finish.

To use closure 24 in a non-child-resistant mode of operation, such as for elderly persons with impaired manual dexterity for whom child-resistance is not needed, the closure is inverted to the orientation of FIG. 4. The closure is then pressed downwardly onto the finish of the container so that closure bead 56 on annular wall 54 resiliently cams wall 54 radially outwardly until bead 56 is received by snap fit over bead 36 at the end of container finish portion 30. Bead 56 preferably is rounded or has axially facing slope cam surfaces to assist securement of the closure to the container in a non-child-resistant mode of operation, and to assist removal of the closure. Inward disposition of annular wall 54 with respect to the outer peripheral edge of closure base wall 42 and skirt 44 provide flexibility to the annular wall for resilient receipt by snap fit over the end of the container finish. Beads 36, 56 preferably are dimensioned so that securement of the closure to the container in the non-child-resistant mode of FIG. 4 brings the upper end of the container into facing engagement with the opposing surface of closure base wall 42. Such abutting engagement cooperates with the engaged beads to seal the package in the non-child-resistant mode of operation.

Figure 10:
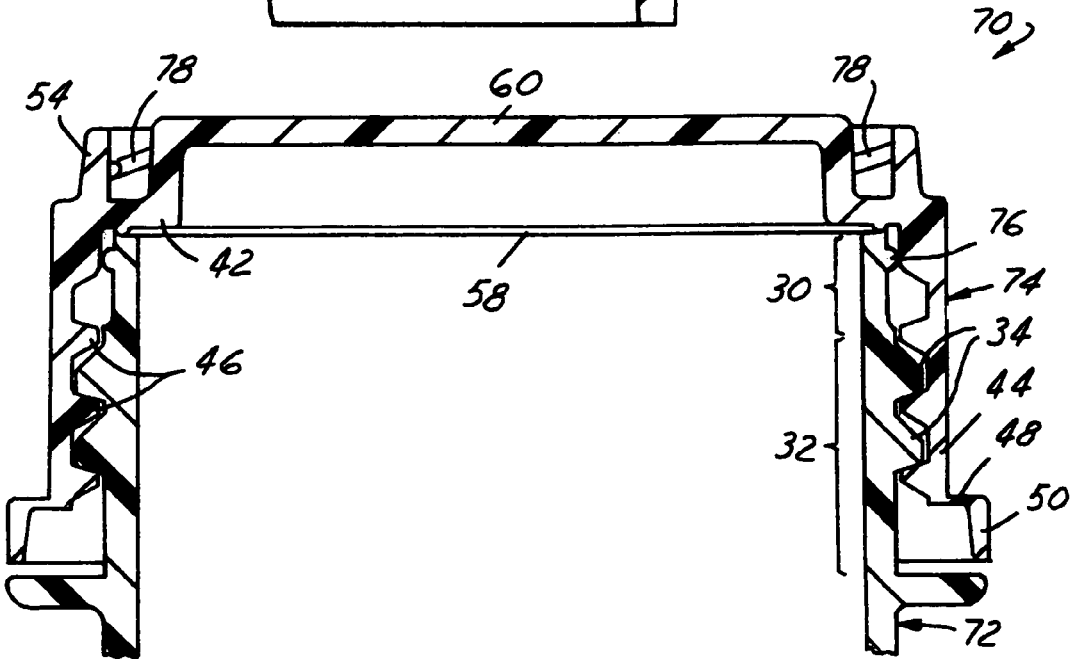
FIG. 10 is a fragmentary sectional view of a package in accordance with a second exemplary but presently preferred embodiment of the invention in a child-resistant mode of operation.
Figure 11:
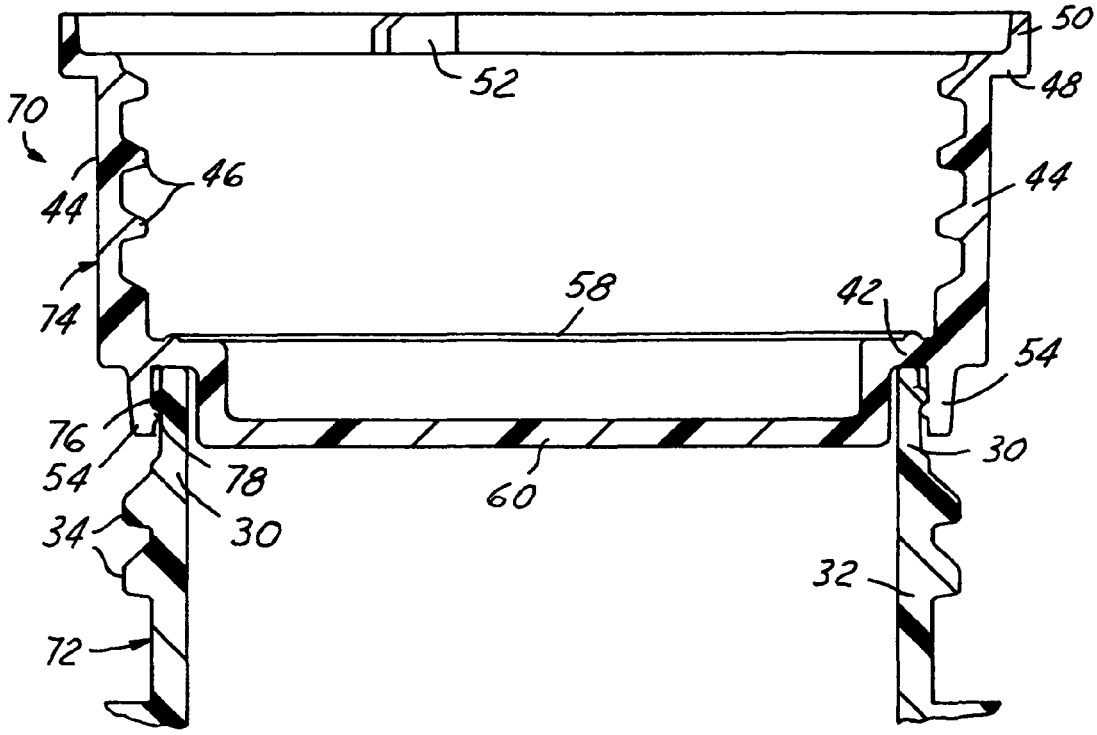
FIG. 11 is fragmentary sectional view of the package in FIG. 10 in a non-child-resistant mode of operation.
Figure 12:
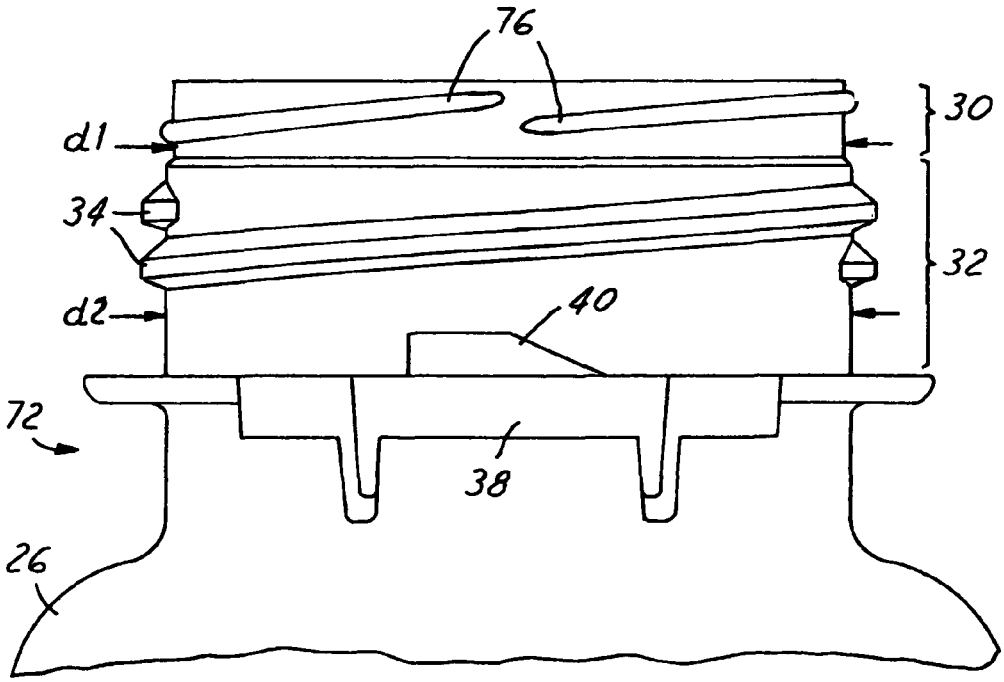
FIG. 12 is a fragmentary elevational view of the container in the package of FIGS. 10-11.
Figure 13:
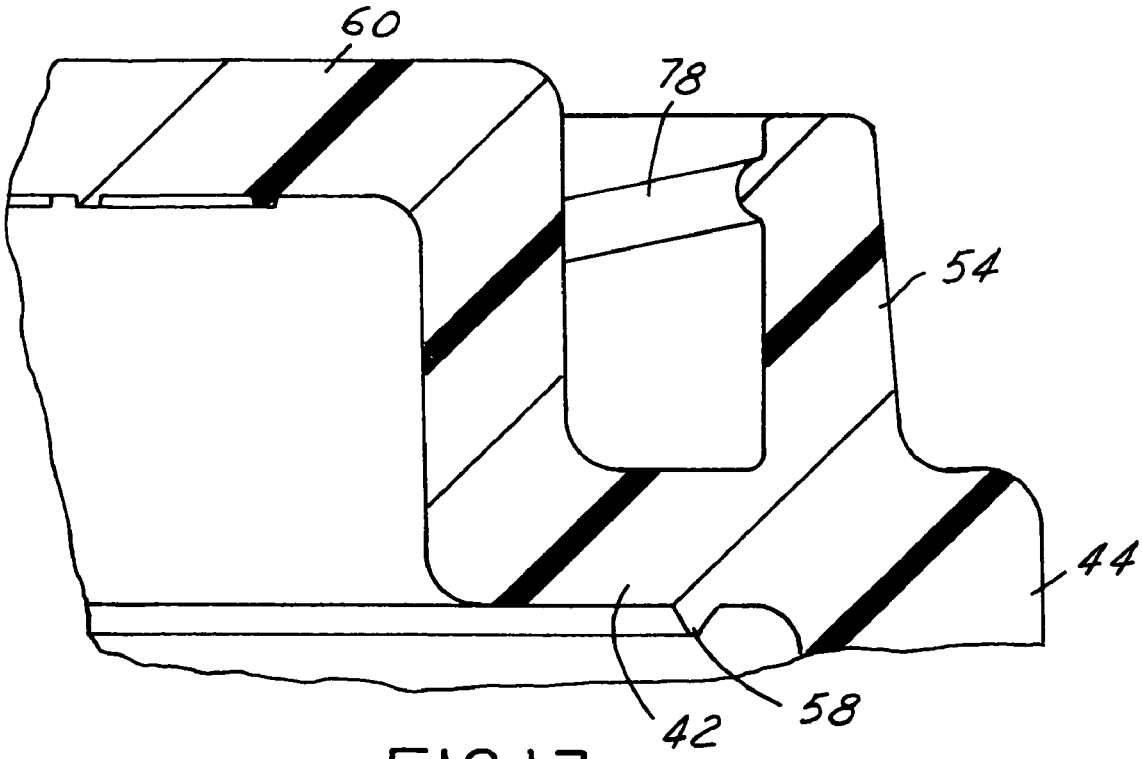
FIG. 13 is a fragmentary sectional view of the closure in the package of FIGS. 10-11.

FIGS. 10-13 illustrate a closure and container package 70, including a container 72 and a closure 74, in accordance with a second exemplary but presently preferred embodiment of the invention. Reference numerals in FIGS. 10-13 that are identical to those employed in connection with FIGS. 1-9 indicate identical or related components. The discussion of the embodiment of FIGS. 10-13 will concentrate on the differences between this embodiment and that of FIGS. 1-9 already discussed in detail. The primary difference between package 70 in FIGS. 10-13 and package 20 in FIGS. 1-9 is that the closure threadably engages the container finish in the non-child-resistant mode of operation in FIG. 11, as distinguished from the snap-bead engagement in FIG. 4. That is, one or more external threads 76 (FIG. 12) extend circumferentially around upper finish portion 30. These threads 76 have an outside diameter that is substantially equal to the outside diameter d2 of container finish portion 32, so that closure skirt 44 is freely receivable over the container finish in the child-resistant mode of operation (FIG. 10). Likewise, one or more internal threads 78 (FIGS. 10 and 13) extend around the internal surface of closure annular wall 54. In the non-child-resistant mode of operation (FIG. 11), annular wall 54 is received over upper finish portion 30 and threads 76, 78 threadably engage to bring the end of the container finish into sealing engagement with the opposing surface of closure base wall 42.

There have thus been disclosed a closure and container package, a closure, a container, and a method of making a closure and container package that fully satisfy all of the objects and aims previously set forth. The invention has been disclosed in conjunction with two exemplary but presently preferred embodiments thereof, and a number of modifications and variations have been described. Other modifications and variations will readily suggest themselves to persons of ordinary skill in the art. The invention is intended to embrace all such modifications and variations as fall within the spirit and broad scope of the appended claims.

The invention claimed is:

1. A package having child-resistant and non-child-resistant modes of operation, which includes:

a plastic container having a cylindrical finish with an open end, at least one first external thread on said finish, a circumferentially extending external first engagement element on said finish consisting of an external bead or at least one second external thread between said at least one first external thread and said open end, said external first engagement element having an outside diameter that is less than that of said first external thread, and a manually deflectable release element externally cantilevered from said finish on a side of said at least one first external thread remote from said open end, and a plastic closure having a base wall, a peripheral skirt with at least one first internal thread for engagement with said at least one first external thread on said finish in a child-resistant mode of operation, at least one locking lug on said skirt for releasable engagement with said release element in the child-resistant mode of operation in which said release element must be deflected to release said lug and enable said closure to be unthreaded from the container finish, an annular wall extending from said base wall in a direction opposite from said skirt, said annular wall being disposed radially inwardly from an outer peripheral edge of said base wall and said skirt, and an internal second engagement element on an inner surface of said annular wall consisting of an internal bead or at least one second internal thread for engagement with said external first engagement element on said finish in an inverted non-child-resistant mode of operation of said closure in which said closure may be removed from said container by disengagement of said first and second engagement elements, said finish having a first portion adjacent to said open end on which said first engagement element is disposed and a second portion spaced from said open end on which said at least one first external thread is disposed, said second portion having an outer diameter that is greater than that of said first portion.

2. The package set forth in claim 1 wherein said first engagement element on said finish has an external diameter that is equal to said external diameter of said second portion of said finish.

* * * * *